US010378866B2

(12) United States Patent
Thomas

(10) Patent No.: US 10,378,866 B2
(45) Date of Patent: Aug. 13, 2019

(54) PROJECTILES

(71) Applicant: Atlantic Inertial Systems Limited, Plymouth, Devon (GB)

(72) Inventor: Henry James Thomas, Plymouth (GB)

(73) Assignee: ATLANTIC INERTIAL SYSTEMS LIMITED, Plymouth, Devon (GB)

( * ) Notice: Subject to any disclaimer, the term of this patent is extended or adjusted under 35 U.S.C. 154(b) by 0 days.

(21) Appl. No.: 15/555,697

(22) PCT Filed: Mar. 4, 2016

(86) PCT No.: PCT/GB2016/050571
§ 371 (c)(1),
(2) Date: Sep. 5, 2017

(87) PCT Pub. No.: WO2016/139485
PCT Pub. Date: Sep. 9, 2016

(65) Prior Publication Data

US 2018/0051968 A1 Feb. 22, 2018

(30) Foreign Application Priority Data

Mar. 5, 2015 (GB) ..... 1503732.8

(51) Int. Cl.
*F42B 10/26* (2006.01)
*F42C 19/02* (2006.01)
(Continued)

(52) U.S. Cl.
CPC ..... *F42B 10/26* (2013.01); *F42B 12/12* (2013.01); *F42C 19/02* (2013.01); *F42B 10/02* (2013.01); *F42B 12/00* (2013.01)

(58) Field of Classification Search
CPC ..... F42B 10/26; F42B 12/12; F42B 10/02; F42B 10/32; F42B 10/48; F42B 10/54; F42B 12/00; F42C 19/02
(Continued)

(56) References Cited

U.S. PATENT DOCUMENTS 3,602,144 A * 8/1971 Korr ..... F42C 19/00 102/257
3,858,515 A * 1/1975 Rusbach ..... F42C 15/184 102/248
(Continued)

FOREIGN PATENT DOCUMENTS

DE 3401513 A1 * 7/1985 ..... F42C 19/02
DE 102005043474 A1 3/2007
(Continued)

OTHER PUBLICATIONS

GB Search Report for Application No. GB1503732.8 dated Apr. 29, 2015, 3 pages.
(Continued)

*Primary Examiner* — James S Bergin
(74) *Attorney, Agent, or Firm* — Cantor Colburn LLP

(57) ABSTRACT

An assembly (2) for attachment to a projectile comprises a first part (4) and a second part (6) mounted for rotation relative to the first part (4) about an axis (A). There is an axial gap (G) between the first and second parts (4, 6). At least one plastically deformable element (34) is arranged within the gap (G) between the first and second parts (4, 6), the plastically deformable element (34) being such as to deform due to the closing of the axial gap (G) between the first and second parts (4, 6) during launch of the projectile.

18 Claims, 2 Drawing Sheets

(51) Int. Cl.
*F42B 12/12* (2006.01)
*F42B 12/00* (2006.01)
*F42B 10/02* (2006.01)

(58) Field of Classification Search
USPC ..... 102/501, 517
See application file for complete search history.

(56) References Cited

U.S. PATENT DOCUMENTS

| | | | | | |
|---|---|---|---|---|---|
| 4,665,332 | A * | 5/1987 | Meir | F16D 59/00 | 102/208 |
| 8,037,821 | B2 * | 10/2011 | Dietrich | F16F 3/093 | 102/200 |
| 8,297,189 | B2 * | 10/2012 | Hoffmann | F42B 12/207 | 102/275.11 |
| 9,347,754 | B1 * | 5/2016 | Cundiff | F42C 19/08 | |
| 2009/0289400 | A1 | 11/2009 | Dietrich | | |
| 2018/0080749 | A1 * | 3/2018 | Thomas | F42B 30/006 | |

FOREIGN PATENT DOCUMENTS

| | | | | | |
|---|---|---|---|---|---|
| GB | 886225 | A | | 1/1962 | |
| JP | 2010078221 | A | | 4/2010 | |
| KR | 20100055344 | A | * | 5/2010 | F42C 19/02 |
| KR | 101413498 | A | | 7/2014 | |

OTHER PUBLICATIONS

Notification of Transmittal of the International Search Report of the International Searching Authority, or the Declaration; PCT/GB2016050571; dated Apr. 15, 2016, 4 pages.

Notification of Transmittal of the Written Opinion of the International Searching Authority, or the Declaration; PCT/GB2016050571; dated Apr. 15, 2016, 6 pages.

* cited by examiner

PROJECTILES

CROSS REFERENCE TO RELATED APPLICATIONS

This is a US National Stage of Application No. PCT/GB2016/050571, filed on Mar. 4, 2016, which claims the benefit of GB Application No. 1503732.8 filed Mar. 5, 2015, the disclosures of which are incorporated herein by reference.

TECHNICAL FIELD

The present disclosure relates to projectiles.

BACKGROUND

A projectile may be subject to high acceleration during launch, for example up to 20,000G. These high accelerations and the resultant forces may lead to damage to components of the projectile during launch.

This is particularly so in projectiles which have parts which may move relative to each other such that on launch the relative movement of the parts may lead to a high impact collision between the two parts. This may lead to a shock wave propagating through the projectile which may create vibration patterns over a range of frequencies which may prove structurally damaging One construction of this type may be where one part is rotatable relative to the other and an axial gap provided between the two parts so as to facilitate the relative rotation. Upon launch of the projectile, however, this gap closes rapidly causing a high impact collision which may damage one or both parts.

SUMMARY

The present disclosure seeks to mitigate this potential problem and from a first aspect provides a projectile comprising a first part and a second part mounted for rotation relative to the first part about an axis of the projectile; an axial gap between the first and second parts; and at least one deformable element arranged within the gap between the first and second parts, the deformable element being such as to deform permanently due to the closing of the axial gap between the first and second parts during projectile launch.

Thus, the high forces associated with launch will, to a large extent, be absorbed by the permanent deformation of the deformable element, preventing a high impact collision between the first and second parts during launch, thereby mitigating or preventing damage to the parts.

The deformable element may be arranged between opposing faces of the first and second parts.

The deformable element may be mounted to one or other of the first and second parts so as to be retained thereby. This may prevent the deformable element becoming loose in the gap after launch of the projectile, thereby potentially interfering with the relative rotation of the two parts.

The deformable element may be a plastically deformable element, and may thus be made from any suitable, plastically deformable material. In some embodiments, the material may be a metal such as aluminium. However, depending on the particular application, other materials for example plastics materials may be used.

The deformable element may most conveniently be constructed as a solid block of permanently, e.g. plastically, deformable material. The block may be forged, cast, moulded, sintered etc.

In other embodiments, however, the deformable element may have an open structure, for example an open lattice structure, which will permanently collapse upon launch of the projectile.

The deformable element may have any convenient shape. In certain embodiments, the deformable element may be cylindrical, for example with a circular cross section. However other cross sections such as square, rectangular, elliptical and so on may be used. In other embodiments, the element may be strip-like, for example extending either completely or incompletely circumferentially around the axis of the projectile.

In certain embodiments, a plurality of deformable elements will be provided. These elements may, for example be circumferentially spaced around the axis of the projectile. The elements may be evenly spaced in embodiments. In one embodiment there may be at least four deformable elements.

To maintain the gap between the first and section parts, biasing means, such as a spring, spring washer or other resilient member may be provided between the parts. The biasing means will resiliently deform during launch as the gap closes due to the permanent, e.g. plastic, deformation of the deformable element, and, once the deformation has occurred, bias the first and second parts away from one another to re-establish the gap between them.

In addition, a bearing may be provided between the two components to allow smooth rotation.

The disclosure can be applied to any two parts of a projectile. It may find particular application, however, in allowing the relative rotation of a tip portion of the projectile to rotate relative to the main body of the projectile. The tip portion may house electronic or other components which may be damaged by impact.

The two parts may be provided in an assembly which can be mounted to the projectile, so from a further aspect there is provided an assembly for attachment to a projectile, the assembly comprising a first part and a second part mounted for rotation relative to the first part about an axis of the projectile; an axial gap between the first and second parts; and at least one plastically deformable [collapsible] element arranged within the gap between the first and second parts, the plastically deformable [collapsible] element being such as to deform due to the closing of the axial gap between the first and second parts during projectile launch.

This may substantially simplify the assembly of the projectile.

The second part may be a tip part and the first part a base to which the tip part is mounted. The base part may comprise means, for example a screw thread, for mounting the assembly to the main body of the projectile.

BRIEF DESCRIPTION OF DRAWINGS

An embodiment of the disclosure will now be described, by way of example only, with reference to the following drawings in which.

DETAILED DESCRIPTION

Figure 1:
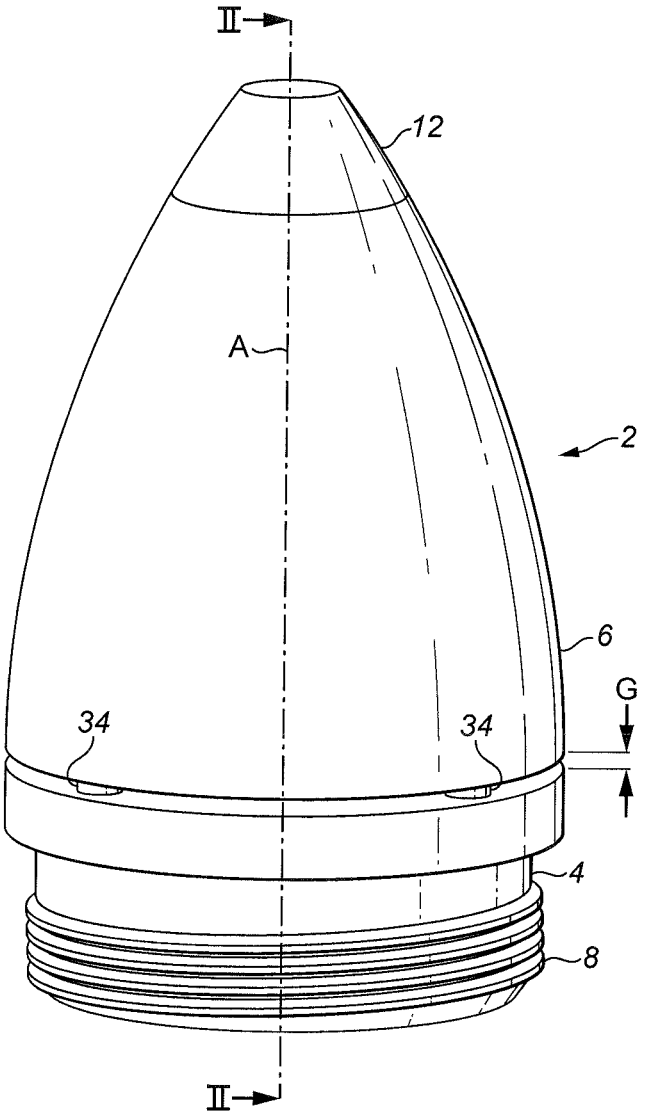
FIG. 1 shows a side perspective view of an assembly in accordance with this disclosure for attachment to a projectile.
Figure 2:
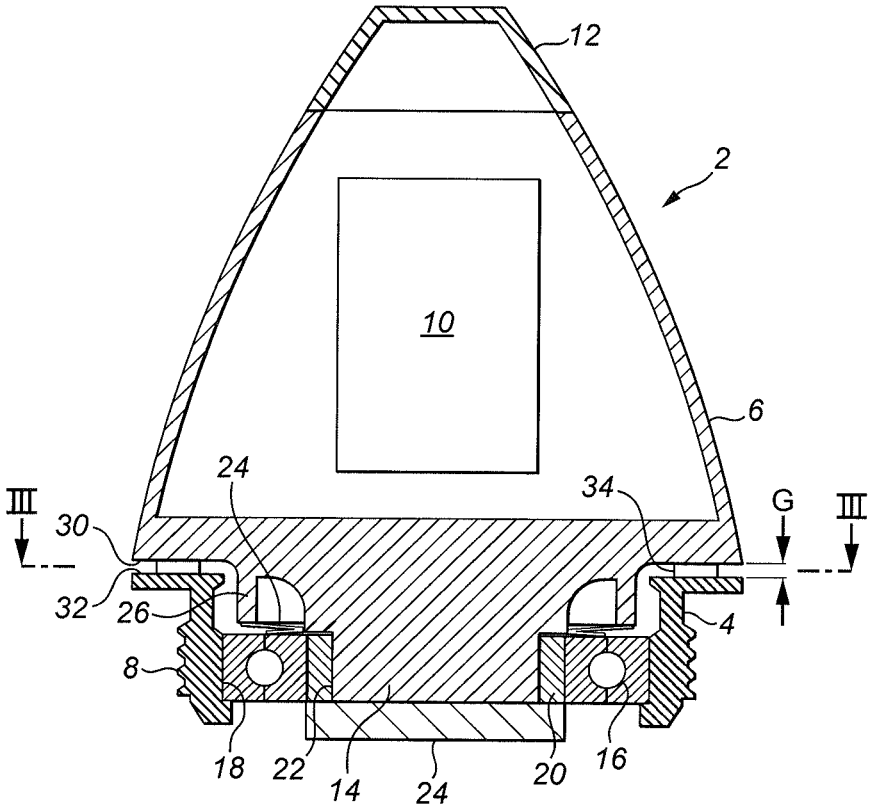
FIG. 2 shows a sectional view along the line II-II of FIG. 1.

With reference to the Figures, an assembly 2 for attachment to the head of a projectile, such as a shell, is shown.

The assembly 2 comprises a first, base part 4 and a second, tip part 6 which is rotatable relative to the first, base part 4 about the longitudinal axis A of the assembly 2. The first, base part 4 is made from a metallic material and has a threaded region 8 for threadingly engaging a thread provided on the body of the projectile to secure the assembly thereto.

The second, tip part 6 houses components 10, for example electronic components and has a plastics cap 12 at one end. It also has a depending spigot portion 14 which extends into the first, base part 4. A bearing 16 is provided between a bore 18 formed in the first, base part 4 and a locating element 20 mounted on the outer surface 22 of the spigot portion 14. A retaining element 24 is mounted to the locating element 20 so as to retain the second, tip part 6 on the base part 4. However, the connection between the locating element 20 and the tip part 6 allows the tip part 6 to move axially relative to the locating element 20 and therefore relative to the base part 4 as will be described further below.

The tip part 6 is biased away from the base part 4 by means of biasing means 24, for example a Belleville washer 24, which is located between the bearing 16 (which is fixedly attached to the base part 4) and a depending lip 26 of the tip part 6. The effect of this bias is to create a gap G between a lower annular surface 30 of the tip part 6 and an upper, opposing, annular surface 32 of the base part 4. The purpose of this gap G is to facilitate the rotation of the tip part 6 about the axis A of the projectile relative to the base part 4. In some embodiments, the gap may be of the order of 0.5 mm, but this may vary depending on the particular application.

Figure 3:
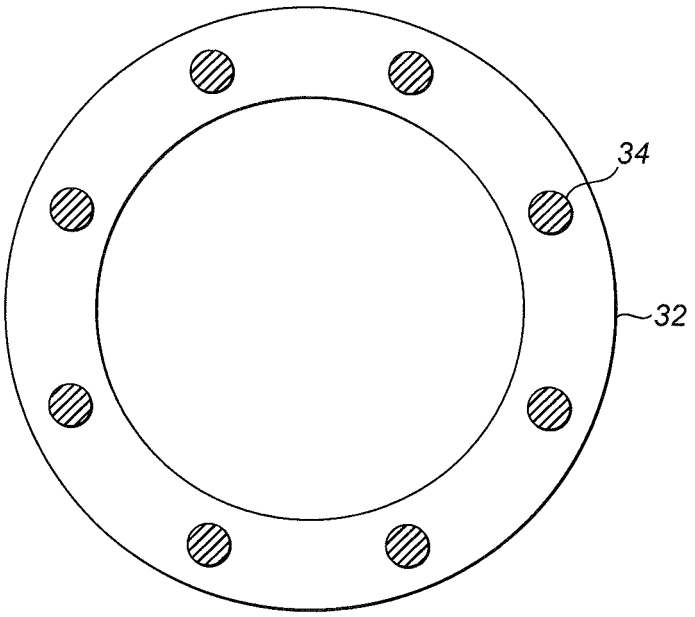
FIG. 3 shows a view along line III-III of FIG. 2 of a base part of the assembly.

As can best be seen from FIG. 3, a plurality of plastically deformable elements 34 are mounted on the upper annular surface 32 of the base part 4. In this embodiment, the deformable elements 34 are formed as solid cylinders of a deformable material, for example a deformable metal such as Aluminium. The elements 34 may be forged, cast, moulded, sintered etc. The deformable elements 34 are arranged in a circumferential array around the axis A.

The deformable elements 34 are sized such that they substantially extend across the gap G at rest. Thus the deformable elements 34 abut or are very closely adjacent the lower annular surface 30 of the tip part 6.

In use, the assembly 2 will be mounted on the tip of a projectile and launched. This will create very large accelerations and high forces. Should the tip part 6 impact the base part 4, then the impact force may set up damaging vibrations in the tip part 6 which could potentially damage at least the plastics cap 12. However, the deformable elements 34 mitigate this problem.

When the projectile is launched at high acceleration, the tip part 6 will move downwardly relative to the base part 4, which will act to close the gap G between the two parts. However, due to the presence of the plastically deformable elements 34, rather than the tip part 6 impact upon the base part 4, the forces generated by the movement will be absorbed in plastically deforming the deformable elements 34 which will reduce in height, allowing the gap G to close somewhat. This prevents, or minimises, any impact forces between the base part 4 and the tip part 6 thereby avoiding or reducing any potentially damaging forces or vibrations in the tip part 6 which might otherwise damage the cap 12 for example.

After launch and deformation of the deformable elements 34, the spring 24 will bias the tip part 6 away from the base part 4 to re-establish the gap G, thereby allowing the tip part 6 to rotate relative to the base part 4, as required.

It will be appreciated that the above description is that of just one non-limiting embodiment of the disclosure and that various modifications may be made thereto without departing from the scope of the disclosure.

For example, the material, construction, number, shape and arrangement of the deformable elements may be varied, as discussed in the introduction. Also, the particular arrangement of the two parts may vary and they need not necessarily form a tip portion of the projectile.

Also, the deformable elements 34 may be mounted to the tip part 6 rather than the base part 4 or even mounted to an intermediate member.

The deformable elements 34 may take a different form from those disclosed. Rather than being a plastically deformable body as disclosed, they could be of any permanently deformable construction, for example a collapsible structure. What is important is that the elements 34 permanently deform such that they do not act to close the gap G after launch.

Also, it will be appreciated that the assembly may be fitted to new equipment or retrofitted to existing equipment by appropriate means. Thus means other than the screw thread 18 may be provided if appropriate.

The invention claimed is:

1. A projectile comprising:

a first part (4);

a second part (6) mounted for rotation relative to the first part (4) about an axis (A);

an axial gap (G) between the first and second parts (4, 6); and a plurality of permanently deformable element (34) arranged within the gap (G) between the first and second parts (4, 6), the permanently deformable element (34) being such as to deform permanently due to the closing of the axial gap (G) between the first and second parts (4, 6) during projectile launch;

wherein the plurality of permanently deformable elements are circumferentially spaced around an axis (A).

2. The projectile as claimed in claim 1, wherein the deformable element (34) is arranged between opposing faces (30, 32) of the first and second parts (4, 6).

3. The projectile as claimed in claim 1, wherein the deformable element (34) is mounted to first part (4) or the second part (6) and retained thereby.

4. The projectile as claimed in claim 1, wherein the deformable element (34) is a plastically deformable element.

5. The projectile as claimed in claim 4, wherein the plastically deformable element is a metallic element.

6. The projectile as claimed in claim 1, wherein the deformable element (34) is constructed as a body of permanently deformable material.

7. The projectile as claimed in claim 1, wherein the deformable element (34) is cylindrical.

8. The projectile as claimed in claim 1, wherein the deformable element (34) is strip-like.

9. The projectile as claimed in claim 8, wherein the deformable element (34) is arcuate and extends either completely or incompletely circumferentially around an axis (A).

10. The projectile as claimed in claim 1, further comprising axial biasing means (24) arranged between the first and second parts (4, 6) for biasing the first and second parts (4, 6) apart.

11. The projectile as claimed in claim 1, further comprising a bearing (16) provided between the first and second parts (4, 6) for facilitating the rotation of the second part (6) relative to the first part (4).

12. An assembly (2) for attachment to a projectile, the assembly (2) comprising:

a first part (4);

a second part (6) mounted for rotation relative to the first part (6) about an axis (A);

an axial gap (G) between the first and second parts (4, 6); and a plurality of deformable element (34) arranged within the gap (G) between the first and second parts (4, 6), the deformable element (34) being such as to deform permanently due to the closing of the axial gap (G) between the first and second parts (4, 6) during projectile launch;

wherein the plurality of permanently deformable elements are circumferentially spaced around an axis (A).

13. The assembly as claimed in claim 12, wherein the deformable element (34) is arranged between opposing faces (30, 32) of the first and second parts (4, 6).

14. The assembly as claimed in claim 12, wherein the deformable element (34) is mounted to first part (4) or the second part (6) and retained thereby.

15. The assembly as claimed in claim 12, wherein the deformable element (34) is a plastically deformable element.

16. The assembly as claimed in claim 15, wherein the plastically deformable element is a metallic element.

17. The assembly as claimed in claim 12, wherein the deformable element (34) is constructed as a body of permanently deformable material.

18. The assembly as claimed in claim 12, wherein the second part (6) is a tip part and the first part (4) is a base part comprising means (18) for mounting the assembly (2) to the projectile.

* * * * *